United States Patent [19]

Gardner

[11] 4,227,641

[45] Oct. 14, 1980

[54] PARTITION STRUCTURE

[75] Inventor: Jeffrey M. Gardner, Wheaton, Ill.

[73] Assignee: Container Corporation of America, Chicago, Ill.

[21] Appl. No.: 120,630

[22] Filed: Feb. 11, 1980

[51] Int. Cl.[3] ..... B65D 5/48

[52] U.S. Cl. ..... 229/42; 229/15

[58] Field of Search ..... 229/42, 27, 15, 28; 217/33, 34

[56] References Cited

U.S. PATENT DOCUMENTS

| | | | |
|---|---|---|---|
| 3,738,561 | 6/1973 | Nederveld | 229/15 |
| 4,030,660 | 6/1977 | Rada et al. | 229/42 |
| 4,127,304 | 11/1978 | Gardner | 229/15 |
| 4,136,815 | 1/1979 | Gardner | 229/42 X |
| 4,143,804 | 3/1979 | Visvydas | 229/42 |
| 4,148,428 | 4/1979 | Gardner | 229/15 |

*Primary Examiner*—Davis T. Moorhead

*Attorney, Agent, or Firm*—Richard W. Carpenter

[57] ABSTRACT

A paperboard partition structure for forming three cells within an outer shipping container or wrapper.

9 Claims, 3 Drawing Figures

PARTITION STRUCTURE

SUMMARY OF THE INVENTION

The invention relates to internal partition structures and more particularly to a foldable paperboard partition for forming three cells within an outer shipping container or wrapper.

It is an object of the invention to provide a partition structure which is capable of being easily and quickly folded into erected position.

A more specific object of the invention is the provision of a partition structure having a bottom wall, a pair of spaced side walls upstanding therefrom, pairs of inner end walls extending from the side walls, and a pair of outer end walls upstanding from the bottom wall.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 3:
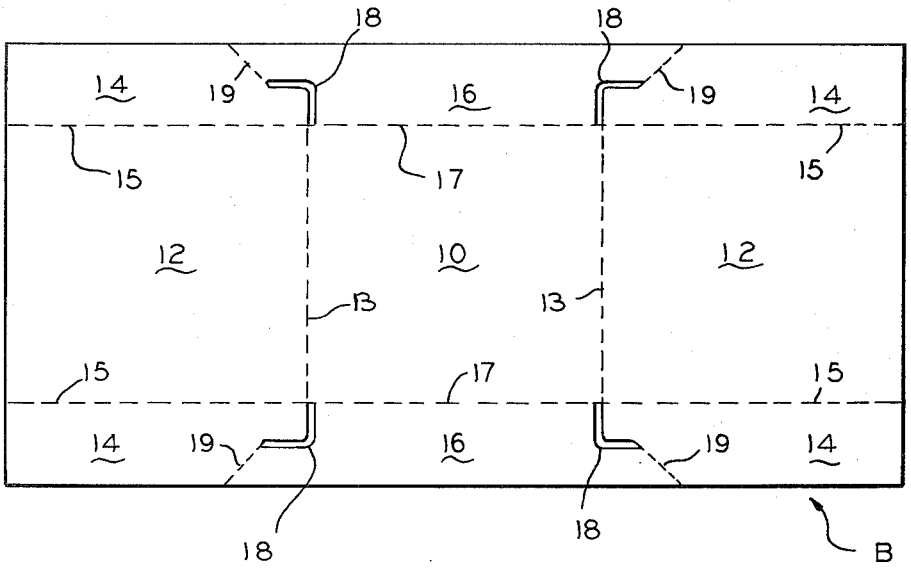
FIG. 3 is a plan view of the blank from which the structure illustrated in the other views may be formed.
Figure 1:
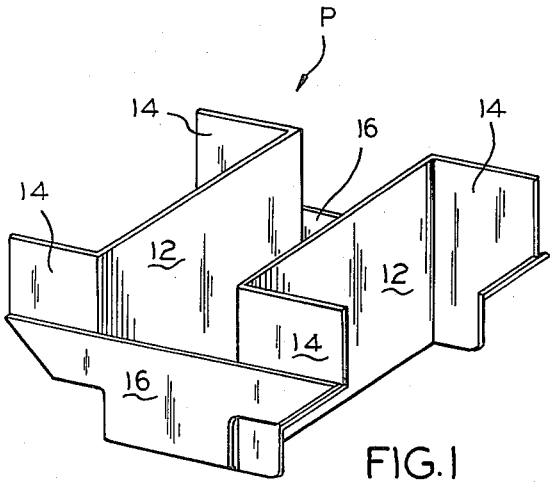
FIG. 1 is a perspective view of a partition structure embodying features of the invention as shown in the erected position.

Referring now to the drawings for a better understanding of the invention, it will be seen that the novel partition structure, indicated generally at P in FIG. 1, may be formed from a unitary blank B of foldable paperboard illustrated in FIG. 3.

The purpose of the invention is to provide a partition structure capable of forming three cells and which lends itself to being erected quickly and efficiently.

The structure comprises a bottom or center panel 10 having a pair of opposed side panels 12 foldably joined at their lower edges along fold lines 13 to the opposed side edges of center panel 10, and disposed to extend upwardly therefrom.

On each end of the side panels 12 are a pair of inner end panels 14 which are foldably joined at their inboard edges along fold lines 15 to adjacent end edges of related side panels 12 and which are disposed to extend outboardly therefrom and normal thereto.

At opposed ends of center panel 10 are a pair of outer end panels 16 which are foldably joined at their lower edges along fold lines 17 to related end edges of center panel 10 and which are disposed to extend upwardly therefrom, outwardly adjacent and in face to face relation with related inner end panels 14.

As best seen in FIGS. 1 and 3, each of the outer end panels 16 is separated from each of its related inner end panels 14 by an L-shaped opening 18 and a diagonal fold line 19.

Opening 18 includes one leg which extends from the juncture of fold lines 13, 15 and 17, outwardly away from bottom and side panels 10 and 12, a distance equal to about half the width of the end panels, and a second leg which extends from the outer extremity of the first leg away from outer end panel 16 and generally normal to the first leg. Diagonal fold line 19 extends outwardly or upwardly from the extremity of the second leg of opening 18 to the corner of outer end panel 16.

Figure 2:
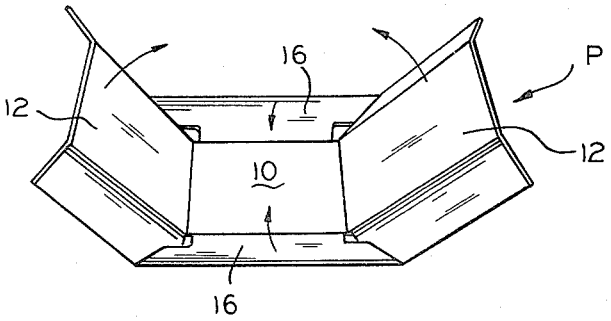
FIG. 2 is a view similar to that of FIG. 1 but showing the manner in which the structure is folded into the erected position.

The novel configuration of the structure and particularly the openings 18 and fold lines 19 serve to provide an arrangement wherein as the opposed side panels 12 are lifted toward each other, as shown in FIG. 2, the remaining portions of the structure will automatically fold into position as shown in FIG. 1.

I claim:

1. A self-erecting structure, formed of a unitary blank of foldable paperboard or the like, for forming three cells within an outer shipping container or wrapper, comprising:

(a) a bottom center panel;

(b) a pair of opposed side panels foldably joined at their lower edges to opposed side edges of said center panel and upstanding therefrom;

(c) opposed pairs of inner end panels foldably joined at their inboard edges to end edges of related side panels and extending outboardly therefrom and normal thereto;

(d) a pair of opposed outer end panels foldably joined at their lower edges to related end edges of said center panel and extending upwardly therefrom outwardly adjacent related inner end panels;

(e) each of said outer end panels having opposed lower edges separated from related inner end panels and having opposed upper edges joined to related inner end panels along fold lines which diverge upwardly to facilitate automatic folding of said structure into erected position.

2. A self-erecting structure, formed of a unitary blank of foldable paperboard or the like, for forming three cells within an outer shipping container or wrapper, comprising:

(a) a bottom center panel;

(b) a pair of opposed side panels foldably joined at their lower edges to opposed side edges of said center panel and upstanding therefrom;

(c) opposed pairs of inner end panels foldably joined at their inboard edges to end edges of related side panels and extending outboardly therefrom and normal thereto;

(d) a pair of opposed outer end panels extending upwardly from end edges of said center panel outwardly adjacent related inner end panels;

(e) each of said outer end panels having opposed lower edges separated from related inner end panels and having opposed upper edges joined to related inner end panels along fold lines which diverge upwardly to facilitate automatic folding of said structure into erected position.

3. A unitary blank of foldable paperboard or the like, cut and scored to provide a partition structure for forming three cells within an outer shipping container or wrapper, comprising:

(a) a bottom center panel;

(b) a pair of opposed side panels foldably joined at corresponding edges to opposed side edges of said center panel;

(c) opposed pairs of inner end panels foldably joined at their inner edges to end edges of related side panels;

(d) a pair of opposed outer end panels foldably joined at their inner edges to related end edges of said center panel between related inner end panels;

(e) each of said outer end panels having first edges separated from related inner end panels and having second edges joined to related inner end panels along fold lines which diverge outwardly from said first edges to facilitate automatic folding of said structure into erected position.

4. A blank according to claim 1, wherein each of said outer end panels is separated from an adjacent inner end panel by an opening and a fold line extending from said opening to an edge of the blank.

5. A blank according to claim 4, wherein said opening is L-shaped and includes one leg extending outward from the inner edges of said outer and inner end panels between said panels and another leg extending normally from the outer end of said one leg away from said outer end panel.

6. A blank according to claim 5, wherein the fold line between the outer and inner end panel extends from the extremity of said other opening leg, remote from said one leg, diagonally outwardly away from said outer end panel.

7. A blank according to claim 1, wherein the height of each outer end panel is equal to the width of each inner end panel.

8. A self-erecting structure, formed of a unitary blank of foldable paperboard or the like, for forming three cells within an outer shipping container or wrapper, comprising:

(a) a pair of opposed side panels spaced from each other in parallel relation;

(b) opposed pairs of inner end panels foldably joined at their inboard edges to end edges of related side panels and extending outboardly therefrom and normal thereto;

(c) a pair of opposed outer end panels disposed outwardly adjacent related inner end panels;

(d) each of said outer end panels having opposed lower edges separated from related inner end panels and having opposed upper edges joined to related inner end panels along fold lines which diverge upwardly to facilitate automatic folding of said structure into erected position.

9. A unitary blank of foldable paperboard or the like, cut and scored to provide a partition structure for forming three cells within an outer shipping container or wrapper, comprising:

(a) a pair of opposed side panels spaced from each other;

(b) opposed pairs of inner end panels foldably joined at their inner edges to end edges of related side panels;

(c) a pair of opposed outer end panels, each being disposed between a pair of related inner end panels;

(d) each of said outer end panels having first edges separated from related inner end panels and having second edges joined to related inner end panels along fold lines which diverge outwardly from said first edges to facilitate automatic folding of said structure into erected position.

* * * * *